US010023944B2

(12) United States Patent
Schnipke et al.

(10) Patent No.: US 10,023,944 B2
(45) Date of Patent: Jul. 17, 2018

(54) COMPOSITIONS AND INTEGRATED PROCESSES FOR ADVANCED WARM-FORMING OF LIGHT METAL ALLOYS

(71) Applicant: HONDA MOTOR CO., LTD, Tokyo (JP)

(72) Inventors: Kevin S. Schnipke, Marysville, OH (US); Alex W. Kawczak, Dublin, OH (US); Philip Vais, Powell, OH (US); Peter Schupska, Columbus, OH (US); Ryan M. Hahnlen, Dublin, OH (US); Joshua P. Dowd, Columbus, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 355 days.

(21) Appl. No.: 14/676,499

(22) Filed: Apr. 1, 2015

(65) Prior Publication Data

US 2015/0275122 A1 Oct. 1, 2015

Related U.S. Application Data

(60) Provisional application No. 61/973,733, filed on Apr. 1, 2014.

(51) Int. Cl.
*C22F 1/00* (2006.01)
*C22F 1/04* (2006.01)
(Continued)

(52) U.S. Cl.
CPC ..... *C22C 23/00* (2013.01); *C10M 141/12* (2013.01); *C22C 14/00* (2013.01); *C22C 21/00* (2013.01); *C22F 1/04* (2013.01); *C22F 1/06* (2013.01); *C22F 1/183* (2013.01); *B21B 3/00* (2013.01); *B21B 45/004* (2013.01); *B21B 45/0239* (2013.01); *B21B 2003/001* (2013.01);
(Continued)

(58) Field of Classification Search
CPC ..... C22F 1/00; C22F 1/04; C22F 1/06; C22F 1/183
USPC ..... 148/667, 670, 695
See application file for complete search history.

(56) References Cited

U.S. PATENT DOCUMENTS 3,242,081 A 3/1966 McHugh et al.
4,032,365 A 6/1977 Bricmont
(Continued)

FOREIGN PATENT DOCUMENTS

AU 57636/94 A 9/1994
EP 1 175 461 11/2000
(Continued)

*Primary Examiner* — Brian Walck
(74) *Attorney, Agent, or Firm* — Arent Fox LLP

(57) ABSTRACT

Systems, methods, and compositions for improved warm-forming of light metal alloys, such as aluminum alloys, magnesium alloys, or titanium alloys, are disclosed. The systems and methods relate to pulse thermal processing, engineered plastic deformation, and micro-aging processes, as well as to the application of multi-functional lubricants. The disclosed multifunctional lubricant compositions provide a number of advantages when used in warm-forming processes, and in one embodiment, include organo-titanates and magnesium hydroxide, and in other embodiments an organo-titanate, magnesium hydroxide and boron nitride.

17 Claims, 5 Drawing Sheets

(51) Int. Cl.

| | |
|---|---|
| ***C22F 1/06*** | (2006.01) |
| ***C22C 23/00*** | (2006.01) |
| ***C22F 1/18*** | (2006.01) |
| ***C22C 14/00*** | (2006.01) |
| ***C22C 21/00*** | (2006.01) |
| ***C10M 141/12*** | (2006.01) |
| *B21B 3/00* | (2006.01) |
| *B21B 45/00* | (2006.01) |
| *B21B 45/02* | (2006.01) |

(52) U.S. Cl.

CPC ..... *B21B 2265/24* (2013.01); *B21B 2267/065* (2013.01); *C10M 2201/02* (2013.01); *C10M 2201/041* (2013.01); *C10M 2201/061* (2013.01); *C10M 2201/062* (2013.01); *C10M 2201/065* (2013.01); *C10M 2201/066* (2013.01); *C10M 2201/081* (2013.01); *C10M 2201/087* (2013.01); *C10M 2207/021* (2013.01); *C10M 2207/126* (2013.01); *C10M 2209/084* (2013.01); *C10N 2210/02* (2013.01); *C10N 2210/04* (2013.01); *C10N 2220/082* (2013.01); *C10N 2240/402* (2013.01); *C10N 2240/404* (2013.01); *C10N 2240/407* (2013.01); *C10N 2250/08* (2013.01); *C21D 2201/03* (2013.01)

(56) References Cited

U.S. PATENT DOCUMENTS

| | | | | |
|---|---|---|---|---|
| 4,090,889 | A | 5/1978 | George et al. | |
| 7,220,936 | B2 | 5/2007 | Ott et al. | |
| 8,205,475 | B2 | 6/2012 | Stork | |
| 8,241,437 | B2 | 8/2012 | Utsunomiya et al. | |
| 2008/0078225 | A1 | 4/2008 | Hanna et al. | |
| 2008/0185079 | A1* | 8/2008 | Krajewski ..... | B21D 22/201 148/696 |
| 2012/0190597 | A1 | 7/2012 | Chatterjee et al. | |
| 2013/0017118 | A1 | 1/2013 | Jeong et al. | |
| 2013/0333436 | A1 | 12/2013 | Nakajima et al. | |

FOREIGN PATENT DOCUMENTS

| | | | |
|---|---|---|---|
| JP | H1150078 | A | 2/1999 |
| JP | 4094801 | B2 | 6/2008 |

* cited by examiner

COMPOSITIONS AND INTEGRATED PROCESSES FOR ADVANCED WARM-FORMING OF LIGHT METAL ALLOYS

CROSS-REFERENCE TO RELATED APPLICATIONS

This application is based on, claims the benefit of, and incorporates herein by reference U.S. Provisional Patent Application Ser. No. 61/973,733 filed on Apr. 1, 2014 and entitled "NOVEL INTEGRATED PROCESS FOR ADVANCED WARM-FORMING OF ALUMINUM ALLOYS."

FIELD

The disclosure relates in general to an integrated process for forming light metal alloys, such as magnesium alloys, aluminum alloys, and titanium alloys.

BACKGROUND

Light metal alloys, such as aluminum alloys and magnesium alloys, are increasingly used in the production of both structural and body parts for automobiles. The use of such materials provides a means for reducing the weight of the automobile while continuing to maintain functional requirements for structural strength and crash resistance.

Aluminum alloys have low formability compared to draw-quality steel, and thus working with these materials presents challenges in obtaining good part definition and optimal formability. As an alternative to straight stamping, warm forming of aluminum alloy sheet has emerged as a way to increase the ductility and formability of the aluminum alloy. As a result, there is a need in the art for optimized warm forming processes to address the continued technical challenges of forming high quality parts using light metal alloys, such as aluminum alloys and magnesium alloys.

SUMMARY

The disclosure relates in general to a warm-forming process for forming light metal alloy sheets or blanks into desired shapes. Light metal alloys include, without limitation, aluminum alloys, magnesium alloys, and titanium alloys. The process integrates one or more of three disclosed sub-processes and/or the use of a disclosed smart-lubricant into an improved warm-forming process.

In one implementation, the disclosure is directed to an integrated process for making a light metal alloy part. The process includes the step of performing one or more of the following on a workpiece comprising a light metal alloy that is undergoing warm-forming: (a) engineered plastic deformation; (b) pulse thermal processing; (c) applying a multifunctional lubricant to the workpiece; and (d) micro-aging processing. Any or all of these steps may performed in any order and in any possible combination.

In some embodiments, the workpiece comprises an aluminum alloy, magnesium alloy, or titanium alloy. In some such embodiments, the aluminum alloy is an aluminum 5xxx series alloy, an aluminum 6xxx series alloy, or an aluminum 7xxx series alloy.

In some embodiments, the engineered plastic deformation is performed by asymmetric shear rolling.

In some embodiments, the multifunctional lubricant includes an organo-titanate and magnesium hydroxide.

In some embodiments, the multifunctional lubricant includes boron nitride, magnesium hydroxide, and an organo-titanate or an organo-zirconate.

In some embodiments, the multifunctional lubricant includes tungsten disulfide or molybdenum disulfide and a solvent vehicle.

In some embodiments, the multifunctional lubricant is capable of being heat or UV activated or moisture activated, or a combination of heat and UV radiation, or a combination of UV, heat and moisture activation.

In some embodiments, the multifunctional lubricant is capable of bonding to the surface of the workpiece (sheets, blanks or preformed metal), and in some embodiments the lubricant self-assembles on the workpiece surface to achieve partial bonding and in some cases self-assembles with no bonding. The self-assembly process assists the lubricity and warm-forming processing.

In some embodiments, the multifunctional lubricant includes one or more of nanostructured carbon black, nanostructured carbon (including, without limitation, carbon nanotubes, graphene, buckeyballs and other nanostructured carbon particle geometries), graphite, boron nitride, a heat activated binder, and a UV radiation activated binder.

In a second implementation, the disclosure is directed to a multifunctional lubricant composition for use in a warm-forming process. The composition includes at least one of: (a) an organo-titanate or an organo-zirconate and magnesium hydroxide; (b) tungsten disulfide or molybdenum disulfide; or (c) nanostructured carbon black or nanostructured carbon (including, without limitation, carbon nanotubes, graphene, buckeyballs and other nanostructured carbon particle geometries), graphite, boron nitride, and a heat or UV activated binder.

In some embodiments, the multifunctional lubricant composition is dry.

In some embodiments, the multifunctional lubricant composition further includes one or more of a solvent, MgO, CuO, $TiO_2$, $MoO_2$, ZnO, zinc stearate, zirconium oxides, sulfides, calcium difluoride, selenides, FeS (ferrous sulfide, and Iron(II) sulfide), and an emulsification additive.

In some embodiments, the solvent is selected from the group consisting of water, a water-oil mixture, and a water-oil emulsion.

In a third implementation, the disclosure is directed to an integrated process for making a light metal alloy part. The process includes: applying a multifunctional lubricant to a workpiece comprising a light metal alloy that is undergoing warm-forming; and performing at least one of: engineered plastic deformation; pulse thermal processing; and micro-aging processing.

In some embodiments, the multifunctional lubricant includes at least one of: an organo-titanate or an organo-zirconate and magnesium hydroxide; tungsten disulfide or molybdenum disulfide; and nanostructured carbon black or nanostructured carbon (including, without limitation, carbon nanotubes, graphene, buckeyballs and other nanostructured carbon particle geometries), graphite, boron nitride, and a heat or UV activated binder.

In some embodiments, the multifunctional lubricant is dry.

In some embodiments, the multifunctional lubricant further includes one or more of a solvent, MgO, CuO, $TiO_2$, ZnO, zinc stearate, zirconium oxides, sulfides, calcium difluoride, selenides, FeS (ferrous sulfide, and iron(II) sulfide), aluminates, zircoaluminates, aluminum acrylates, and an emulsification additive.

In some embodiments, the solvent is selected from water, a water-oil mixture, and a water-oil emulsion.

In some embodiments, the light metal alloy is an aluminum alloy, a magnesium alloy, or a titanium alloy. In some such embodiments, the workpiece includes an aluminum alloy selected from an aluminum 5xxx series alloy, an aluminum 6xxx series alloy, and an aluminum 7xxx series alloy.

DETAILED DESCRIPTION

Figure 1:
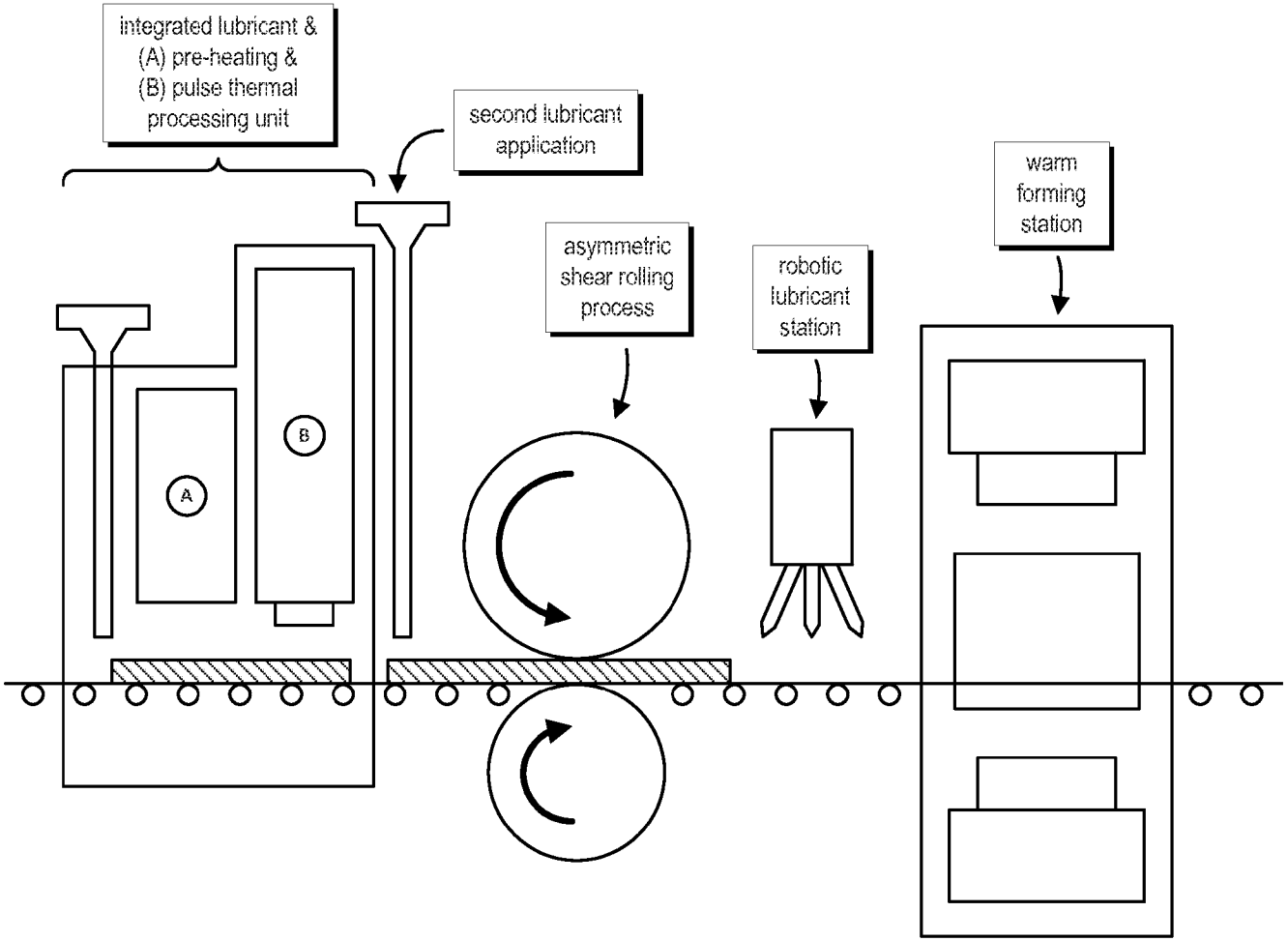
FIG. 1 is a schematic illustration of an exemplary system for performing the disclosed process, in accordance with one aspect of the present disclosure.

A process is disclosed to form light metal alloys, such as, without limitation, magnesium alloys and aluminum alloys. The process includes the integration of the use of one or more multi-functional "smart lubricants" and one or more thermo-mechanical treatments, resulting in novel "engineered-surfaces" and "engineered material deformations" that enable the warm forming of aluminum alloys at 180 C to 350 C, at 200-225 C, and/or up to 250 C, with desirable mechanical properties and corrosion resistance attributes. The disclosed process is a novel warm forming process defined by the integration of lubricants, lubricant application methods, thermal treatment methods, and/or mechanical deformation methods. In some embodiments aging methods applied to the blank and/or post-formed metal component are also integrated. The resulting post-formed metal can be directly painted with or without the application of aging methods.

The present system and method is presented in several varying embodiments in the following description and with reference to the Figures. References throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification can, but does not necessarily, refer to the same embodiment.

The described features, structures, or characteristics of the disclosure can be combined in any suitable manner in one or more embodiments. In the following description, numerous specific details are recited to provide a thorough understanding of embodiments of the system. The system and method can both be practiced without one or more of the specific details, or with other methods, components, materials, and so forth. In other instances, well-known structures, materials, or operations are not shown or described in detail to avoid obscuring aspects of the disclosure.

By integrating thermo-mechanical sub-processes with multifunctional lubricant technology and lubricant application methods, we target superior formability of aluminum alloy blanks/sheet by engineering a microstructure in the bulk of the sheet and a unique surface layer microstructure and surface texture. Accordingly, the disclosed processes, systems, and compositions include the following features. These features can be provided either alone, or in combination with any of the other disclosed features.

1. ENGINEERED PLASTIC DEFORMATION

Engineered plastic deformation is used to achieve superior formability of Aluminum Alloy sheet by engineering a microstructure in the bulk of the sheet and a unique surface layer microstructure and surface texture. In a non-limiting example, an asymmetric shear rolling process is developed that provides repeatable, robust and simultaneous control of the plane strain compression with shearing stresses to create a desired grain refinement and desired planar anisotropy. Isothermal and asymmetric shear rolling may be combined to develop a novel rolling process and warm-forming process for 7xxx series alloys that is enabled by the formation of unique "near surface deformation layers" and the desired evolution of the microstructure and dislocation density. Commercial and prototype 6xxxx and 7xxxx alloys may be evaluated by producing nanometer and micrometer grain size profiles. The synergy of "Pulsed Thermal Processing" (PTP) (see below) and other high temperature heating with the asymmetric shear rolling process development may provide further benefits.

When combined with a multi-functional lubricant (see below), the asymmetric shear rolling process enables the creation of unique "near surface deformation layers" and with the directed/programmed grain size evolution during the thermo-mechanical subprocess and the desired microstructure and dislocation density for optimal warm forming and subsequent retention of mechanical properties.

When combined with a multi-functional lubricant (see below), the asymmetric shear rolling process with and without additional thermal treatments enables the creation of unique engineered surface layers on the aluminum alloy workpiece that constitute a layer or layers of a novel composition of matter resulting from the bonding of the multi-functional lubricant with the aluminum alloy and aluminum oxides present and formed during the shear rolling processes. One embodiment would be a multi-functional lubricant that is formulated with zircoaluminates and/or aluminum acrylates and/or zirconates and aluminates that would bond with the surface of the workpiece to create a novel boundary layer composition and then would be shear roll mixed with the surface layer to yield a novel composition for enhanced warm forming and post forming painting. In some embodiments, the boundary layer, the surface layer, and/or the near subsurface layer constitute a novel composition of matter. In some such embodiments, one or more of these layers may constitute a novel metal composition. In other such embodiments, one or more of these layers may constitute a hybrid organo-metal-ceramic layer composition. In yet other such embodiments, one or more of these layers may constitute a metal-metalloid and metal-metalloid-ceramic layer.

2. PULSE THERMAL PROCESSING

An embodiment of the disclosure includes utilizing "Pulse Thermal Processing" (PTP) technology to enable very rapid heating rates over large aluminum alloy sheet/blank areas, and to a programmed surface depth and within short processing times. PTP can be used before, during and after shear rolling processes, during, before and/or after sheet forming, and a combination thereof. PTP may utilize high-density infrared plasma arc lamps with power densities from 5-30 kW/cm$^2$ to achieve surface and sub-surface heating rates of 50 C-500 C per second.

By combining and integrating Pulse Thermal Processing (PTP) with asymmetric shear rolling, we have developed a novel rolling process and warm-forming process for 7xxx series alloys and other light metal alloys, such as other aluminum alloys, magnesium alloys, and titanium alloys, that are enabled by the formation of unique "near surface deformation layers" and the desired evolution of the microstructure and material dislocation density. We utilize PTP to achieve very high heating rates, and rapid thermal annealing on the localized surface area of the aluminum alloy sheet and workpiece. This combined and integrated process results in novel aluminum alloy and magnesium alloy morphological microstructure compositions and nanostructured compositions within the "near surface deformation layers" and final warm-formed part.

In a non-limiting example, the surface of the sheet to a depth of 200 nm to 0.2 mm would be heated 100 C/s to 500 C/s to achieve localized nanostructured and microstructural changes that are conducive to improved formability and final formed component tensile, creep resistance and corrosion resistance properties. The inventive surface engineering includes altering solid-phase crystallization processes and beneficially reducing the grain size and strengthening precipitates (disperoid size) to affect the forming stage tribology (friction, surface chemistry/topography, and lubricant efficacy). Another embodiment of this idea is to subject alloys with superplastic microstructures, like Al 5083 to PTP, to enhance formability, eliminate springback and increase tensile property profiles.

In another non-limiting example, nanometer and micrometer grain size profiles may be produced in 6xxxx and 7xxxx alloys by applying PTP and/or other high temperature heating methods in conjunction with the asymmetric shear rolling process and the multi-functional lubricants and nanostructured multi-functional lubricants, described in this disclosure, to create the favorable tribological system for warm forming.

The PTP technology will enable very rapid heating rates over large sheet/blank areas, and at short processing times. It is envisioned to be used before, during and after shear rolling processes, during, before and/or after sheet forming and a combination thereof. In a non-limiting example, PTP may utilize high-density infrared plasma arc lamps with power densities from 5-30 kW/cm$^2$.

3. MULTIFUNCTIONAL LUBRICANTS

The disclosure includes use of one or more multifunctional lubricants that can impart multi-faceted attributes to the sheet/blank, for localized control of emissivity profiles for controlled and/or localized heating, tailored control of friction, improved formability, increased tensile properties, enhanced creep resistance, and improved corrosion resistance. This multi-functional lubricant may also be termed a "smart-lubricant" that can do more than just effect the materials coefficients of frictions.

The lubricant may be applied to the blank, the blank and the draw die, or the draw die alone. The lubricant may be applied in multiple steps manually and/or by robotic application techniques/methods. The smart lubricant may be a formulated one-part lubricant or a two-part or three-part dry or wet formulation that is applied in one-step or multiple-steps. The lubricant process may involve the application of two or more lubricant formulations at different steps in the disclosed warm-form forming process (pre-thermal treatment, pre-shear rolling process treatment, lubricant application during shear-rolling, lubricant application before warm forming and during warm forming selectively on the draw die and other metal surfaces). Following are non-limiting examples of lubricant formulations encompassed by the disclosure.

The lubricant formulation may include organo-titanates, magnesium hydroxide and various solvents which could be water and/or a water/oil mixture or emulsion. This formulation could also be a dry lubricant.

The lubricant formulation may include boron nitride, magnesium hydroxide, and organo-tinates and/or zirconates and a solvent vehicle, which could be water or a combination of bio-based solvents. This lubricant could also be a dry lubricant that could be applied with dry application methods, including electrostatic application methods.

The lubricant formulation may include MgO and magnesium hydroxide with organo-titanates.

The lubricant formulation may include tungsten disulfide and/or molybdenum disulfide, with or without organo-titanates, with or without zirconates, and a solvent vehicle with or without emulsification additives.

The lubricant may be heat activated and/or UV-activated selectively in localized regions of the blank/sheet and die/tooling. A manual and/or robotic method could be used to selectively expose regions of the coated blank and/or drawing die with UV-radiation to activate or further activate the multi-functionality of the applied lubricant or lubricants.

The lubricant may bond with the surface of the Mg, steel, and/or aluminum alloy, creating a novel composition of matter at the surface of the blank/sheet or formed component (surface engineering functionality) resulting in one improvement, or a balance of improvements such as improved tribological properties, mechanical properties, hardness characteristics, spring back control, paintability characteristics.

The lubricant formulation may include nanostructured carbon black, graphite, boron nitride and heat or ultraviolet (UV) radiation activated binders that improve the selective adhesion and tribological characteristics of the lubricant during the shear rolling process and the warm-forming process steps.

4. MICRO-AGING PROCESSES

The disclosure optionally includes use of one or more micro-aging processes. The processes include maintaining a portion or all of the mechanical stresses imparted during the forming stage in addition to elevated temperatures over a prescribed time period to achieve, either fully or partially, the desired microstructure of the final formed part. The disclosure includes holding forming pressure for a period of time to promote stress-dependent microstructure orientations. Precipitation times for Al that has been plastically deformed is much shorter, leading to faster aging processes. The plastic strains in forming are more than sufficient to achieve this. Furthermore, microstructures can be oriented in the presence of applied stress. This is different than removing a formed part from the die and then aging as stresses have significantly dropped. This preferential orientation of precipitates could be used to our advantage.

The processes includes maintaining a portion or all of the mechanical stresses imparted during the forming stage or in the case of multi-step forming processes, the first forming stage that achieves 10-30% of the final draw. One embodiment of the micro-aging sub-process is to utilize lubricants and asymmetric shear rolling that is coupled to a preliminary warm-forming draw that achieves 10-30% of the total desired draw. The pre-formed blank is then transferred to a high pressure autoclave chamber for micro-aging where after a prescribed temperature, pressure and time profile the desired microstructure is produced. After this micro-aging step, the pre-form is removed from the autoclave chamber, further lubricated and the warm forming process (final draw) is completed.

In another embodiment, the micro-aging sub-process is performed on blanks that have no surface treatment or have been modified with an micro-aging promoting coating layer. The blanks are subjected to a prescribed temperature, pressure and time profile or series of profiles that enable the attainment of a microstructure for enhanced warm forming processing.

Another embodiment includes performing the micro-aging subprocess on the fully formed component. In addition to elevated temperatures over a prescribed period of time to achieve, either fully or partially, the desired microstructure of the final formed part, the disclosure includes holding forming pressure for a period of time to promote stress-dependent microstructure orientations. The evolved microstructure results in some or all of the following: increased yield and ultimate strength of the resulting part, anisotropic strengthening, reduced springback of formed part, reduction of internal residual stresses, reduction of post-forming deformation upon subsequent heating (such as PTP described above or additional heat treatments), and increased resistance to corrosion. The additional time and temperature may also allow for degradation of the previously applied smart lubricants facilitating their removal from the formed part for future processes such as welding, adhesive joining, or painting.

FIG. 1 illustrates an exemplary embodiment of the disclosed improved warm-forming process. From left to right, the blank is first passed through an integrated lubricant (left), preheating (A), and pulse thermal processing (B) unit. A second lubricant is applied, and the blank is subsequently subjected to the asymmetric shear rolling process. A robotic lubricant station is used to apply a further lubricant, after which the blank enters the warm-forming station. Holding forming pressure and time can be used to optimize micro-aging.

Figure 2:
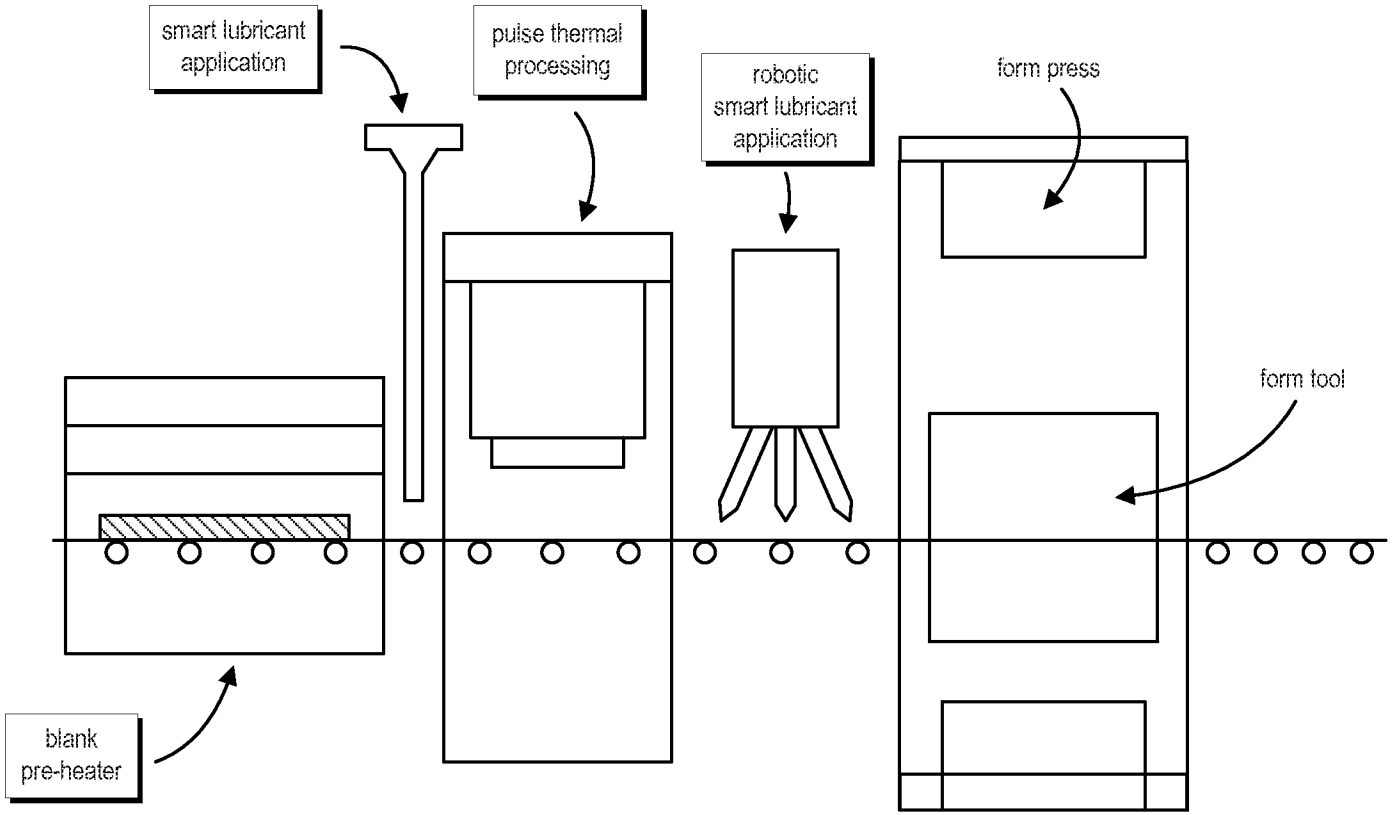
FIG. 2 is a schematic illustration of another exemplary system for performing the disclosed process, in accordance with another aspect of the present disclosure.

FIG. 2 illustrates another exemplary embodiment of the disclosed improved warm-forming process. From left to right, the blank is first pre-heated. A "smart" lubricant is applied, and the blank is subsequently subjected to pulse thermal processing. A robotic lubricant station is used to apply a further lubricant, after which the blank enters the form press, to be formed using the form tool. Holding forming pressure and time can be used to optimize micro-aging.

Figure 3:
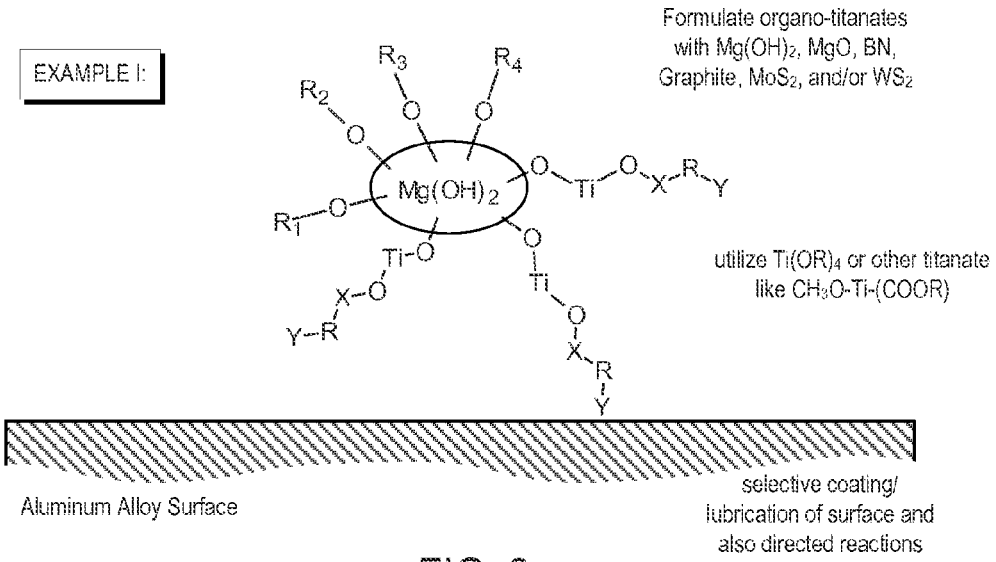
FIG. 3 is a schematic illustration of an exemplary multi-functional lubricant composition, in accordance with one aspect of the present disclosure.

FIG. 3 illustrates an exemplary embodiment of the disclosed multifunctional lubricant. The aluminum alloy surface may be selectively coated with lubricant, which contains organo-titanates formulated with $Mg(OH)_2$, MgO, BN, $MoS_2$, and/or $WS_2$. The lubricants described may also be considered for application to forming materials other than aluminum, such as magnesium, titanium, and/or steel.

Figure 4:
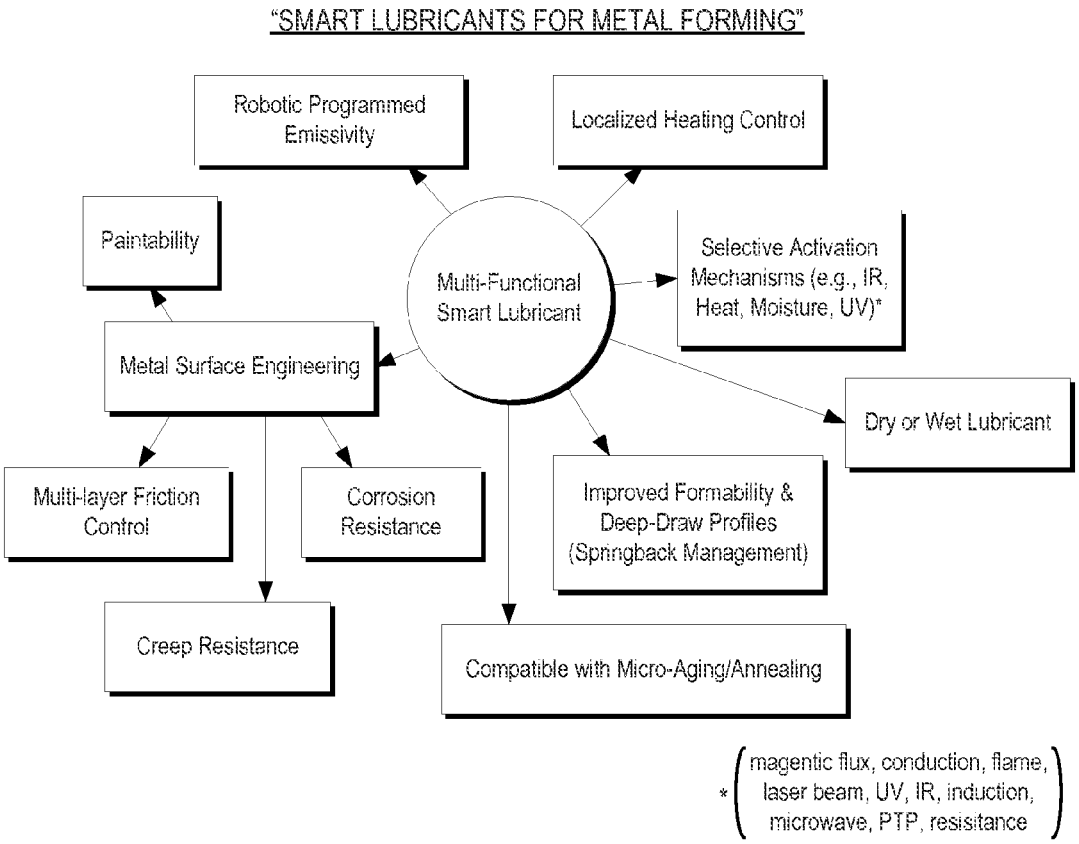
FIG. 4 is a flow chart illustrating the characteristics of and uses for the multi-functional lubricant composition, in accordance with one aspect of the present disclosure.

FIG. 4 illustrates the functions and advantages provided by using the disclosed multifunctional lubricants.

Figure 5:
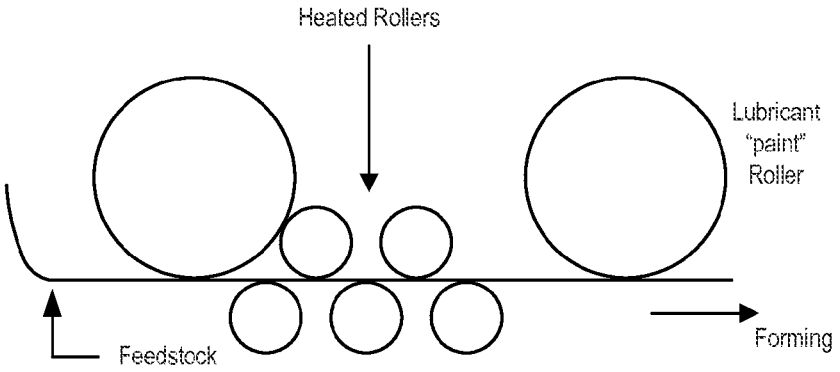
FIG. 5 is a schematic illustration of an exemplary system for performing the disclosed process, in accordance with yet another aspect of the present disclosure.

FIG. 5 illustrates an exemplary embodiment for heating and lubrication applications. The heated rollers may include one or more lubricant "Coating Roller." The rolling process may integrate a solid lubricant on sheet stock surface. The rolling process may further include a PTP surface heating sub-Process. The heating and lubrication process shown may also incorporate the asymmetric shear rolling already discussed. Such embodiments may use graphite/boron nitride lubricant blends, and/or biobased solid carrier for graphite and/or graphite/BN.

The method may utilize a Friction Stir Process to modify microstructure to augment the rolling process. The friction stir welding concept is used to modify the grain and material structure in a homogenous material for locally affecting material properties within a larger piece of material. Depth may be variable, and surface modifications possible without full depth or penetration of the friction stir tool.

5. FURTHER EXAMPLES

Figure 6:
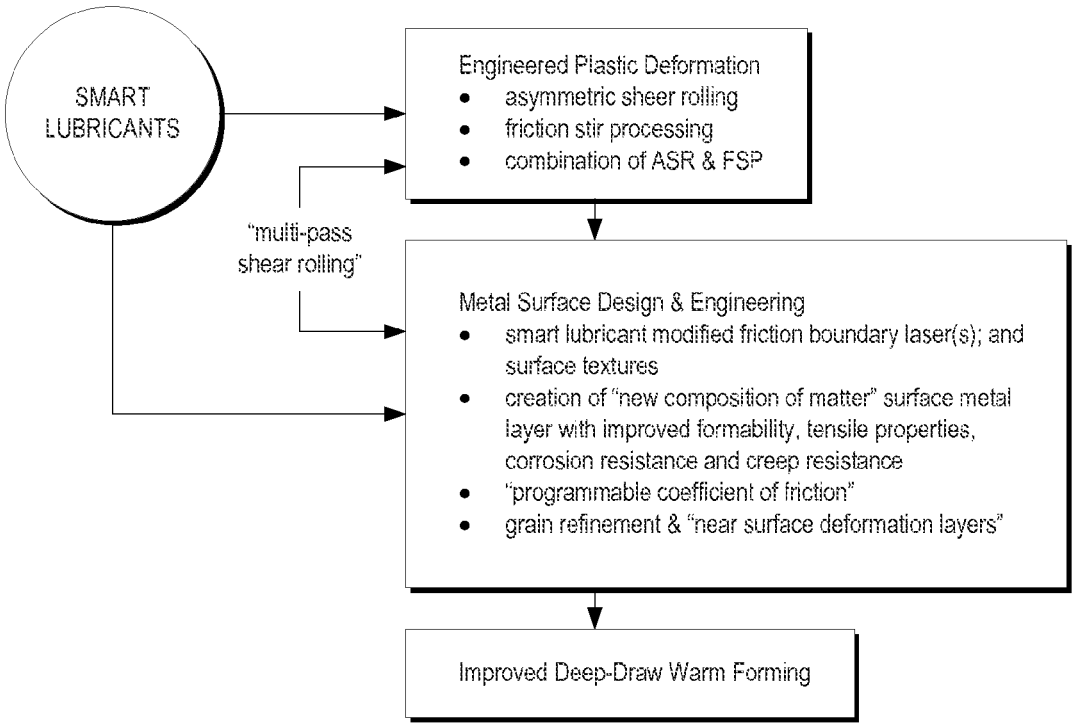
FIG. 6 is flow chart illustrating the characteristics of and uses for the multi-functional lubricant composition, in accordance with another aspect of the present disclosure.

Turning now to FIG. 6, multi-functional (smart) lubricant compositions may be applied to processes including engineered plastic deformation. Further smart lubricants may be incorporated into the design and engineering of metal surfaces yielding, for example, improved deep-draw warm forming.

One example of a multi-functional lubricant includes a class of molecules known as titanates:

$$(RO\text{-}(\text{-}_{z*}Ti\text{-})\text{-}OX'R'Y')_{4-z*}$$

In one aspect, the (RO) group may be used to achieve a reactive approach with other lubricant components and "bonding" with a light metal alloy surface, such as an aluminum alloy or magnesium alloy surface (use hydrolyzable properties to achieve reactivity). It is also possible to use the (Ti—O—) to get affinity to a light metal alloy surface, such as an aluminum alloy or magnesium alloy surface.

Some example titanates for formulating lubricants include i) titanium IV 2,2(bis 2-propenolatomethyl)butanolato, tris (dioctyl)pyrophosphato-O; ii) titanium IV 2,2(bis-2-propenolatomethyl)butanolato, tris(2-ethylenediamino)ethylato; iii) titanium IV ethylenediolato, bis(dioctyl)pyrophosphato-O; and iv) titanium IV 2-propanolato, tris(dioctyl)pyrophosphato-O.

All MSDS precautions and safe laboratory procedure must be practiced, small scale TGA and DSC testing should be first performed on all formulations, and toxicology testing performed before use. Furthermore, environmental, health and safety testing needs to be performed during development, subject to local, state and federal regulations and standards. Such testing should be performed before any scaling-up of any lubricant formulation and/or metal processing step or sub-process from the laboratory to pilot plant, and before scaling up to manufacturing plants.

In some embodiments, for example titanates and zirconates for the formulation of "smart lubricants" as shown above, X' is a functional group which can include a sulfonyl, phosphato, pyrophosphato, or carboxyl. In another aspect, R' is a functional group which can include a butyl, isopropyl, octyl, isostearoyl, and other aliphatics. R' can also be an aromatic benzyl, cumyl phenyl group, naphthenic, dodecylbenzyl. In yet another aspect, Y' is a functional group that can be a mercapto, amino, aryl, methacryl, and UV activated or UV dissociated groups. In a further aspect, for z*, a mono-organofunctional, difunctional, or trifunctional molecule can be designed.

Figure 7:
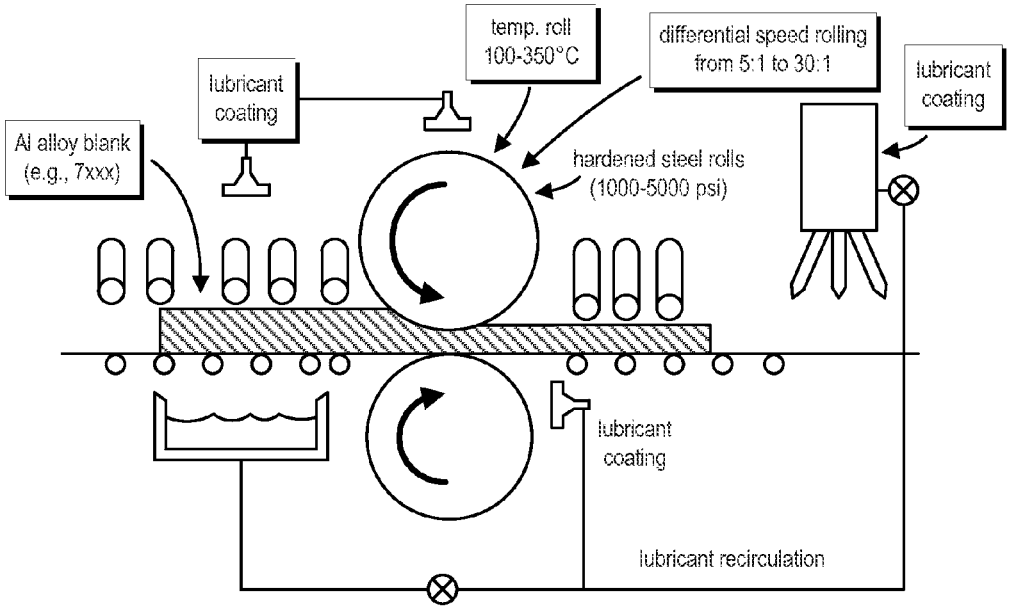
FIG. 7 is a schematic illustration of another exemplary system for performing the disclosed process, in accordance with another aspect of the present disclosure.
Figure 8:
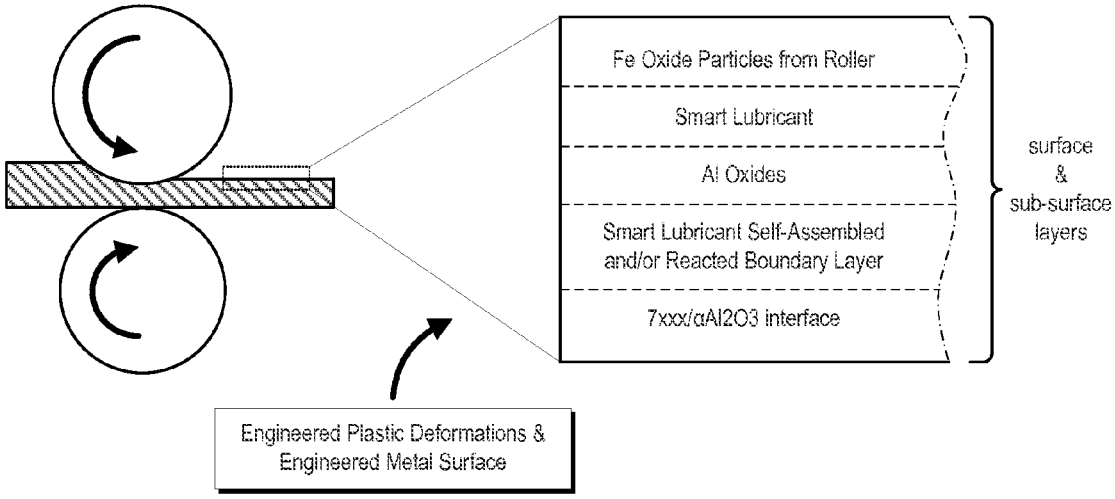
FIG. 8 is an example of an enlarged partial view of the rollers and roll formed material illustrated in FIG. 7, and further showing an example composition of a metal surface of the roll formed material before the warm forming process.

Further embodiments of a process according to the present disclosure may include the application of multifunctional lubricants to the working material or process equipment at multiple points throughout the forming process (see FIGS. 7 and 8). The process may further include differential speed rolling. As highlighted in FIG. 8, the forming process may result in a material having various surface and subsurface layers including an iron oxide particle layer, a smart lubricant layer, an aluminum oxide layer, a smart lubricant self-assembled or reacted boundary layer, an interface layer, or a combination thereof that constitutes a novel material composition and/or novel morphological composition.

The present disclosure leverages the experiences in room temperature aluminum forming and hot-stamping of high-strength steels to develop a new process for warm forming of lightweight metal. The described approaches enable faster processing time for complex components, lower cost and reduced energy consumption during forming, understanding of the formability limits and design guidelines for working in high-strength alloys, and focus on minimal energy consumption and manufacturing $CO_2$ emissions.

Components manufactured using the disclosed embodiments may include, without limitation, structures which require an element of strength, stiffness and energy absorption in their operational environment including center pillars, side sills and chassis components such as control arms and subframes. Use of the disclosed technology can result in increased tensile strength of a finished component with greater total elongation at failure. In another aspect, warm forming (processing) temperatures will be less than about 225° C.

Differential speed rolling has been shown to increase the anisotropy (r-value) when applied to the last two passes in a 1xxx series aluminum alloy. In sheet metal forming, the higher the r-value increases the resistance to necking during forming. Improvements in the limiting draw ratio (LDR) are observed with high R-value materials. Differential speed rolling may be applied to the 7xxx alloys to reduce the grain size, improve the texture and widen the temperature window where forming can be accomplished. The expected reduction in grain size has the promise of increasing both the ultimate tensile strength and elongation.

Two pass rolling to achieve final thickness on lightweight metals with a combination of temperature and asymmetric rolling may be used to reduce the grain size and impart a favorable texture.

The asymmetrically modified rolled sheet can be introduced into the forming process to improve the results obtained when warm forming of Al 7xxx or magnesium alloys.

Cooling conditions after warm forming can be controlled to obtain the desired mechanical, corrosion and coating conditions. In some embodiments, the warm formed parts may be treated under different cooling conditions to achieve desired mechanical and corrosion characteristics.

Although the present disclosure has been presented with respect to preferred embodiment(s), any person skilled in the art will recognize that changes can be made in form and detail, and equivalents can be substituted for elements of the present disclosure without departing from the spirit and scope of the disclosure. Therefore, it is intended that the present disclosure not be limited to the particular embodiments disclosed, but will include all embodiments falling within the scope of the appended claims.

What is claimed is:

1. An integrated process for making an alloy part, wherein the alloy part comprises an alloy selected from the group consisting of an aluminum alloy, a magnesium alloy, a titanium alloy, and a combination thereof, the process comprising:

simultaneously performing engineered plastic deformation and pulse thermal processing on a workpiece comprising the alloy;

applying a lubricant and/or a multifunctional lubricant to the workpiece; and subsequently warm-forming the workpiece to provide the alloy part.

2. The process of claim 1, wherein the workpiece comprises an aluminum alloy that is selected from the group consisting of an aluminum 5xxx series alloy, an aluminum 6xxx series allow, and an aluminum 7xxx series alloy.

3. The process of claim 1, wherein the engineered plastic deformation is performed by asymmetric shear rolling.

4. The process of claim 1, wherein the multifunctional lubricant comprises an organo-titanate and magnesium hydroxide.

5. The process of claim 1, wherein the multifunctional lubricant comprises boron nitride, magnesium hydroxide, and an organo-titanate or an organo-zirconate.

6. The process of claim 1, wherein the multifunctional lubricant comprises tungsten disulfide or molybdenum disulfide and a solvent vehicle.

7. The process of claim 1, wherein the multifunctional lubricant is capable of being heat or UV activated.

8. The process of claim 7, wherein the multifunctional lubricant is capable of bonding to the surface of the workpiece.

9. The process of claim 1, wherein the multifunctional lubricant comprises one or more members selected from the group consisting of nanostructured carbon black, nanostructured carbon, graphite, boron nitride, and one or more of the following activation binders from the group consisting of heat activated binder, moisture activated binder, peroxide activated binder, and a UV radiation activated binder.

10. An integrated process for making an alloy part, the process comprising:

applying a multifunctional lubricant to a workpiece comprising an alloy selected from the group consisting of an aluminum alloy, a magnesium alloy, a titanium alloy, and a combination thereof;

simultaneously performing engineered plastic deformation and pulse thermal processing on the workpiece; and subsequently warm-forming the workpiece to provide the alloy part.

11. The process of claim 10, wherein the multifunctional lubricant comprises at least one of:

(a) an organo-titanate or an organo-zirconate and magnesium hydroxide;

(b) tungsten disulfide or molybdenum disulfide; and (c) nanostructured carbon black or nanostructured carbon, graphite, boron nitride, and a heat or UV activated binder.

12. The process of claim 11, wherein the multifunctional lubricant is dry.

13. The process of claim 11, wherein the multifunctional lubricant further comprises one or more members of the group consisting of a solvent, MgO, CuO, $TiO_2$, ZnO, zinc stearate, zirconium oxides, sulfides, calcium difluoride, selenides, FeS (ferrous sulfide, and iron(II) sulfide), aluminates, zircoaluminates, aluminum acrylates, and an emulsification additive.

14. The process of claim 13, wherein the solvent is selected from the group consisting of water, a water-oil mixture, and a water-oil emulsion.

15. The process of claim 10, wherein the workpiece comprises an aluminum alloy selected from the group consisting of an aluminum 5xxx series alloy, an aluminum 6xxx series allow, and an aluminum 7xxx series alloy.

16. The process according to claim 1, wherein the process further comprises micro-aging processing the workpiece.

17. The process according to claim 10, wherein the process further comprises micro-aging processing the workpiece.

* * * * *